US006293130B1

(12) United States Patent
Ramsauer

(10) Patent No.: US 6,293,130 B1
(45) Date of Patent: Sep. 25, 2001

(54) SWIVELLING LEVER CONTROL THAT CAN BE PADLOCKED FOR CLOSING SWITCHBOARD CABINET DOORS OR THE LIKE

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/254,215

(22) PCT Filed: Mar. 5, 1998

(86) PCT No.: PCT/EP98/01239

§ 371 Date: Mar. 3, 1999

§ 102(e) Date: Mar. 3, 1999

(87) PCT Pub. No.: WO99/01633

PCT Pub. Date: Jan. 14, 1999

(30) Foreign Application Priority Data

Jul. 4, 1997 (DE) ..... 297 11 737 U

(51) Int. Cl.[7] ..... E05B 13/00

(52) U.S. Cl. ..... 70/2; 70/203; 70/208; 70/212; 292/148; 292/205; 292/281; 292/283

(58) Field of Search ..... 70/2–13, 203, 70/208, 212; 292/104, 148, 150, 205, 207, 208, 281, 282, 283, 284

(56) References Cited

U.S. PATENT DOCUMENTS 688,747 * 12/1901 McMillen .
1,312,931 * 8/1919 Tenny et al. ..... 292/205
2,485,012 * 10/1949 Palmer et al. ..... 292/205 X
3,212,804 * 10/1965 Hickey ..... 292/104 X
3,500,668 * 3/1970 Henry .
3,674,962 * 7/1972 Kroeger .
4,134,281 * 1/1979 Pelcin ..... 70/208
5,257,839 * 11/1993 Nielsen et al. ..... 292/113
5,469,725 * 11/1995 Yamada ..... 70/208

FOREIGN PATENT DOCUMENTS

0261267 * 3/1988 (EP) .
0450699 * 10/1991 (EP) .
2583093 * 12/1986 (FR) .
2276415 * 9/1994 (GB) ..... 292/205
WO91/17334 * 11/1991 (WO) .

* cited by examiner

*Primary Examiner*—Lloyd A. Gall
(74) *Attorney, Agent, or Firm*—Reed Smith LLP

(57) ABSTRACT

The disclosure relates to a swivel lever actuator which can be secured by a padlock for the closure of switch cabinet doors or the like, with a dish which is arranged on the outer surface of the door or the like and in which is arranged the lock shaft, wherein an actuating lever is articulated at the free end of the lock shaft as to be swivelable out of the dish about an axis extending transverse to the shaft axis, and with a projection carried by the actuating lever, wherein an eyelet is arranged at the free end of the projection in such a way that when the lever is swiveled into the dish a padlock inserted through the eyelet prevents the actuating lever from swiveling out. The projection is mounted at the actuating lever so as to be displaceable, rotatable and/or swivelable in such a way that it can move relative to a second projection securely fastened to the actuating lever such that the two eyelets are aligned with one another and a padlock can be inserted through the eyelets.

26 Claims, 13 Drawing Sheets

SWIVELLING LEVER CONTROL THAT CAN BE PADLOCKED FOR CLOSING SWITCHBOARD CABINET DOORS OR THE LIKE

The present application is a U.S. National Stage Application under 35 U.S.C. 371 based upon International Application No. PCT/EP98/01239 filed Mar. 5, 1998 claiming priority to German Application No. 29711737.8 filed Jul. 4, 1997.

BACKGROUND OF THE INVENTION

1. Technical Field

The invention is directed to a swivel lever actuator which can be secured by a padlock for the closure of switch cabinet doors or the like, with a trough or dish which is arranged on the outer surface of the door or the like and in which is arranged the driving device for the closure, such as a toothed-wheel drive, lever drive or lock shaft, wherein an actuating lever is articulated at the driving device so as to be swivelable out of the dish about an axis extending parallel to the outer surface of the door or the like, and with a projection mounted on the swivel lever actuator, wherein an eyelet is arranged at the free end of the projection in such a way that when the lever is swiveled into the dish a padlock inserted through the eyelet prevents the actuating lever from swiveling out (locking position).

2. Description of the Related Art

A swivel lever actuator of the type mentioned above which can be secured by a padlock is already known from page 2–105 of a catalog from DIRAK GmbH & Co. KG, Kaiserstr. 55–59, 58332 Schwelm. A disadvantage in this known arrangement is that the projection, which is fastened to the dish in this case, lies in the movement path of the user's hand holding the actuating lever after the actuating lever has been swiveled out, so that there is a risk that the useres hand could be injured by the projection.

FR 2583093 A1 discloses a lever closure which can be fixed in a determined position by means of a padlock. The projection used for locking is also provided in this reference and presents a risk of injury to the hand of the user.

EP 0 261 267 B1 discloses a rod closure for sheet-metal cabinet doors which works with a swivel lever actuator that can be secured in the swiveled in state by means of a cylinder lock. This reference does not provide for securing by means of a padlock.

WO 91/17334 discloses a swivel lever closure which can be locked by cylinder lock devices and which, similar to the above-mentioned closure according to EP 0 261 267 B1, can be mounted in a thin wall, such as a sheet-metal cabinet door, and is formed of a base plate having two projections which penetrate the door leaf. One projection serves for the connection of a rod drive or the like or to support a drive shaft or the articulating shaft for the swivel lever, but also serves at the same time to fasten one end of the base plate, while the other projection has a recess for receiving the cylinder lock device which holds the swivel lever in its swiveled in position and simultaneously serves to fasten the other end of the base plate. However, there are no devices for additionally securing the closure by a padlock.

OBJECT AND SUMMARY OF THE INVENTION

It is the primary object of the invention to further develop the arrangement mentioned above in such away that this risk of injury is eliminated and operation is facilitated.

A further disadvantage in the known arrangement consists in that when no padlock is inserted the swivel lever is prevented from swiveling out only when a cylinder lock or key-operated lock is additionally provided, which is not desirable in many cases. When there is no profile cylinder, there is a risk in the known arrangement that as a result of shaking movement to which the swivel lever closure may be subject, for example, during earthquakes or during operation or transport, the swivel lever will swivel out to the extent that the projection formed by the padlock will exit the area of the lever and enable the swivel lever to rotate with the lock shaft. This rotation results in the risk of unwanted opening of the cabinet door.

Shaking movements of the kind mentioned above occur in particular when the arrangement is provided on a crane installation where there are often a plurality of, e.g., as many as 30, switching installations which are enclosed by a switch cabinet that is secured by switch cabinet doors.

Therefore, a further object consists in making possible a construction in which the actuating lever, in its swiveled in position, is also prevented from swiveling out in an unwanted manner when a cylinder lock or the like is not provided and also when no padlock is inserted.

This object is met in that the projection is mounted at the actuating lever so as to be displaceable and/or rotatable and/or swivelable, in that the actuating lever has a second projection with an eyelet, and in that the eyelet of the first projection is situated close to and flush with the eyelet of the second projection in the locking position of the actuating lever.

As a result of these steps, the formerly troublesome projection swivels out with the hand lever, so that it no longer interferes with the user's hand when the closure is activated by means of the lever and the hand can no longer be injured. At the same time, it becomes possible to lock the hand lever in its swiveled in position automatically, wherein this locking can be canceled again in that the projection is, e.g., displaced, rotated or swiveled.

According to a further development of the invention, the first projection is displaceable parallel to the longitudinal axis of the actuating lever. For example, it can be displaced from a first position, in which its eyelet is aligned with the eyelet of the second, nondisplaceable projection, into a position which is offset approximately by the width of an eyelet.

BRIEF DESCRIPTION OF THE DRAWINGS

The invention will be described more fully hereinafter with reference to embodiment examples shown in the drawings.

DESCRIPTION OF THE PREFERRED EMBODIMENTS

Figure 1:
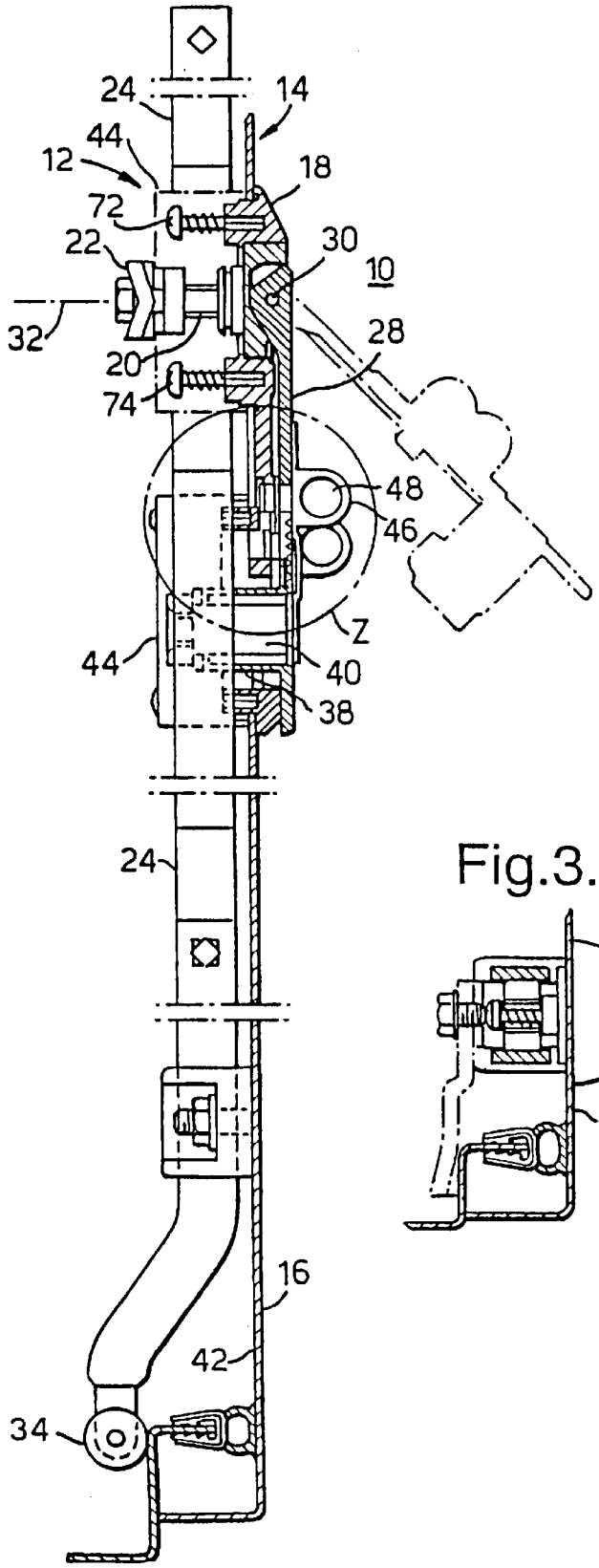
FIG. 1 is a side view of a flat rod closure with a swivel lever actuator which is provided with an arrangement according to the invention, shown in the unlocked position.
Figure 6:
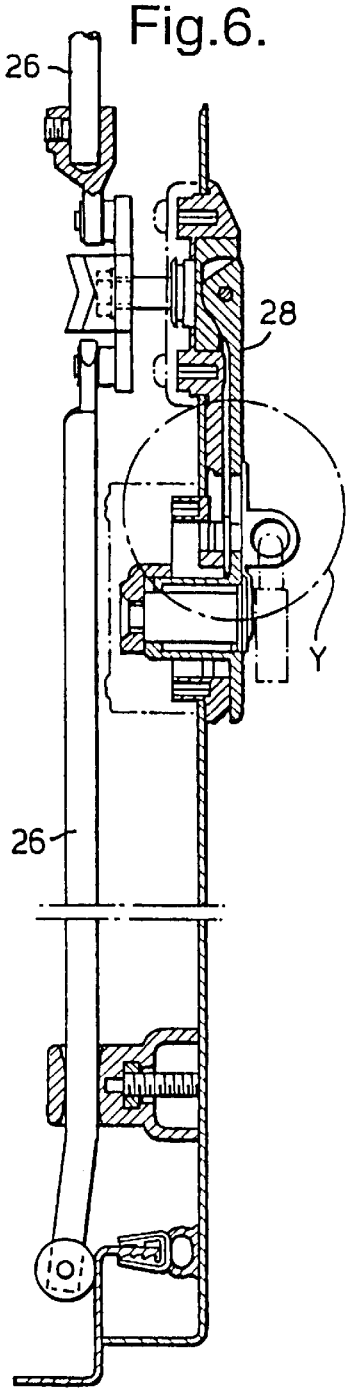
FIG. 6 shows a view of the swivel lever actuator shown in FIG. 1 in connection with a round rod closure, in the locked position.

FIG. 1 is a side view showing a swivel lever actuator 10 for the closure 12 of a switch cabinet door 14, a housing wall, sheet-metal case cover or the like, with a dish 18 which is arranged on the outer surface 16 of the switch cabinet door 14 or the like and in which is arranged a lock shaft 20 which drives, for example, a sash 22 or, alternatively or additionally, flat strip rods 24 (FIG. 1) extending along the door leaf or, in yet another application, round rods 26 (FIG. 6). In this connection, reference is had to the European Patent 0 054 225 as an application example.

Figure 3:
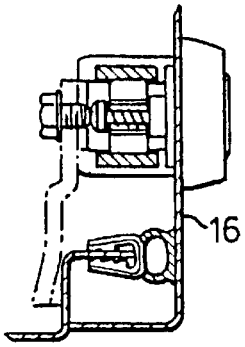
FIG. 3 shows a top view of the arrangement according to FIG. 1 with a quarter-turn or sash device shown in dashed lines.

An actuating lever 28 is articulated at the free end of this lock shaft 20 so as to be swivelable out of the dish 18 about an axis 30 extending transverse to the axis of the shaft 20. In the swiveled out state, as can be seen in FIG. 1, the shaft 20 can be rotated with the actuating lever 28 about its axis 32. In this rotating movement, for example, the existing sash 22 is swiveled out of the door frame of a switch cabinet and the door is accordingly opened (FIG. 3). Alternatively or in addition, the flat strip rod 24 in FIG. 1 is moved upward out of its locking position shown in the Figure, so that the stop wheel 34 is released from the edge of a switch cabinet housing 36 and enables the door leaf 14 to move away from the housing 36 and accordingly makes it possible to open the door 14.

On the other hand, in the swiveled in position of the actuating lever 28 shown in solid lines in FIG. 1, this actuating lever 28 is enclosed by the edges of the dish and is accordingly prevented from being rotated out of its position aligned with the dish. This position is generally the locking position of the swivel lever closure 12.

If the hand lever is directed vertically downward in this position, its own gravitational force or friction can suffice to keep it in this position. However, during shaking movements such as those which can occur, for example, in crane installations, there is a risk that the hand lever 28 will move out of its swiveled in position and into the swiveled out position shown in dashed lines in FIG. 1. In this position, rotation can also take place about axis 32 due to further shaking movement, so that the closure 12 opens in certain cases and therefore exposes the interior of the switch cabinet in an unwanted manner. It is also possible that an unauthorized person will swivel out the hand lever 28 and move the closure out of its closed position into an open position by rotating about the axis 32 and will accordingly be able to open the door 14 of the switch cabinet 36. However, the hand lever 28 can be provided with a protrusion 38 at its free end according to the view shown in FIG. 1, wherein a cylinder lock 40 can be received in this protrusion 38. The locking member of the corresponding cylinder can be mounted in such a way that it contacts the rear surface 42 of the door leaf 14 in the locked state when the hand lever 28 is swiveled in and accordingly prevents the hand lever 28 from being swiveled out of its swiveled in position in an unwanted manner. Alternatively, a locking member of this kind can also lie behind a contact face formed by a screwed on casing 44. The disadvantage in this case consists in that it cannot necessarily be seen whether or not the cylinder 40 is locked, i.e., it becomes more difficult to monitor the locking state. Further, cylinder locks have certain disadvantageous characteristics such as sensitivity to dust, complicated assembly, high costs and the like.

Figure 2:
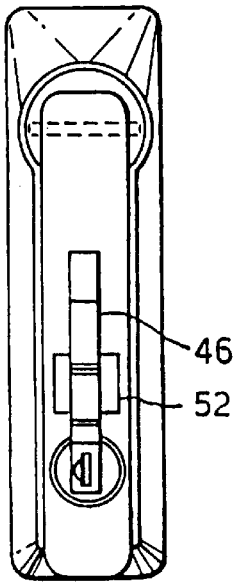
FIG. 2 shows a top view of the swivel lever actuator of FIG. 1.

In order to provide additional or alternative security, a projection 46 can be provided which is carried by the swivel lever actuator or, more precisely, by its actuating lever 28 (see FIGS. 1, 8 and 9), wherein an eyelet 48 is arranged at the free end of the projection 46. This projection 46 is displaceable at the actuating lever 28 according to FIG. 9 or is displaceable and/or swivelable according to other embodiment forms to be described hereinafter, namely in such a way that its eyelet can be moved into the vicinity of and so as to be flush with another eyelet 50 (or, alternatively, an opening or recess) of a second projection 52 which is likewise carried by the swivel lever 28. The second projection 52 can be constructed in such a way, according to FIG. 2 or 10, that it engages around the first projection 46 in a U-shaped manner.

The swivel lever actuator 10 may have a driving device especially for the flat rod closure 12 shown in FIG. 1 and 3 in the form of a tooth-wheel drive 800 seated on lock shaft 20 and meshing with teeth which may be formed in the flat rods 24. Another possibility is a lever drive as shown in FIG. 6 to move round rods 26.

Figure 8:
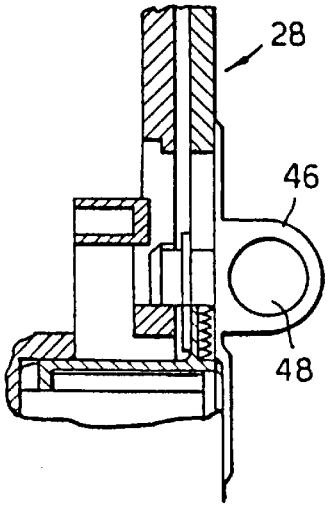
FIG. 8 shows an enlarged view of the projection of FIG. 6 in the locked position.
Figure 9:
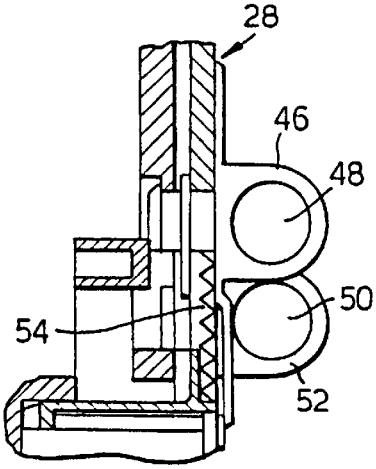
FIG. 9 shows an enlarged view of the projection of FIG. 1 in the unlocked position.
Figure 7:
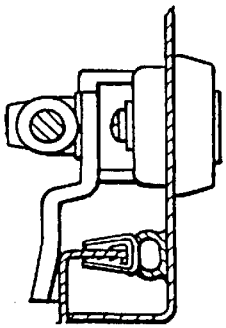
FIG. 7 shows a top view of the arrangement according to FIG. 6.
Figure 10:
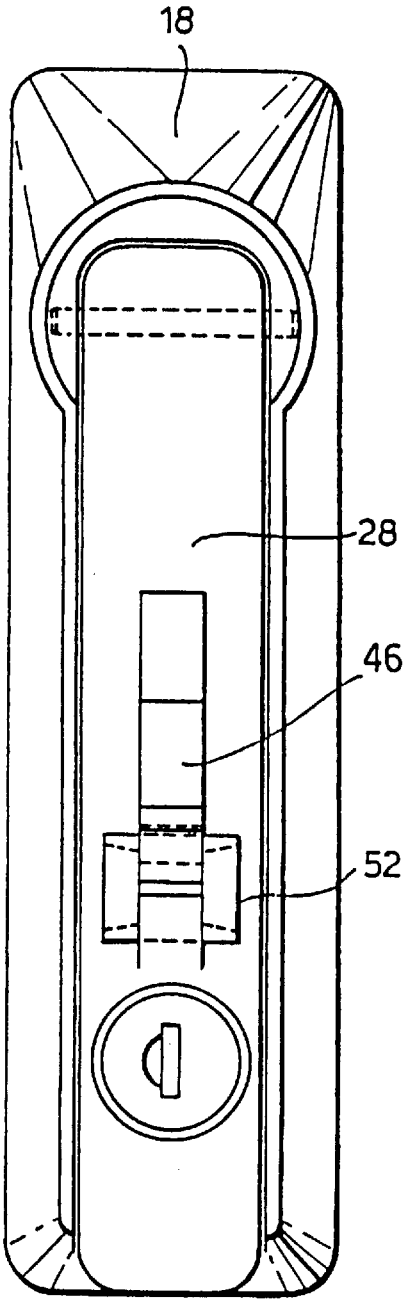
FIG. 10 is a view similar to FIG. 2 showing a more exact view of a swivel lever actuator constructed according to the invention with a securing device.
Figure 11:
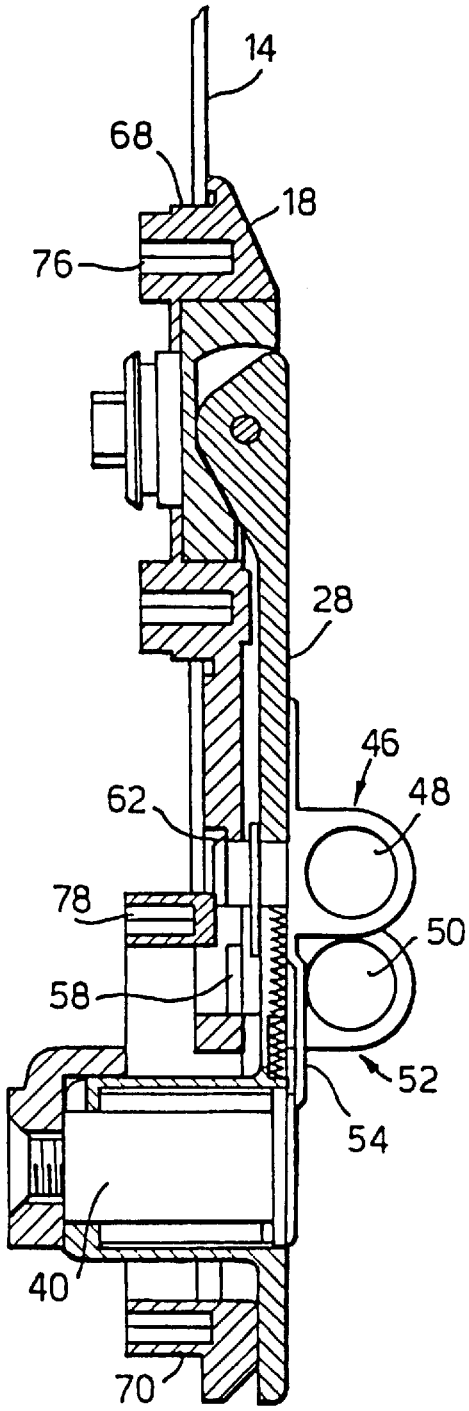
FIG. 11 shows a longitudinal sectional view through the arrangement according to FIG. 10 in a first position of the two eyelet parts.
Figure 12:
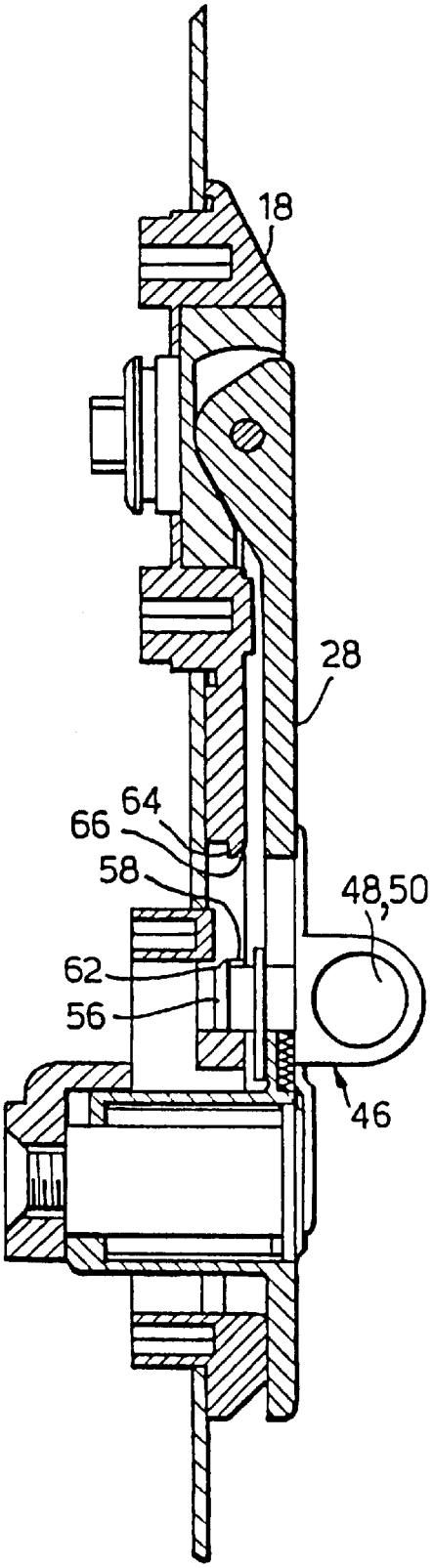
FIG. 12 is a view similar to FIG. 11 showing the second position of the two eyelet parts.

The displaceable projection 46 can be displaced from its offset position, shown in FIGS. 1 or 9 or 11, in the direction of the projection 52 against the force of a spring 54 until the two eyelet openings 48, 50 are aligned with one another (see FIG. 8 of 12). In this position, lateral protrusions 56 which are formed by the inner end of the displaceable projection 46 contact the rear of protrusions 58 formed by the dish 18. The hand lever is accordingly held in the illustrated position (FIGS. 8 and 12). A shackle of a padlock 60 (see, for example, FIG. 21) which is inserted through the eyelets 48, 50 holds the projection 46 in the position shown in FIG. 8. The hand lever 28 is accordingly also locked in its swiveled in position. When the padlock is removed, the projection 46 can be moved upward in the direction of the longitudinal axis of the hand lever, wherein this displacement is assisted by the spring 54. As soon as the protrusion 56 leaves the protrusion 58 during this displacing movement, the projection 46 is released and the swivel lever can be swiveled outward as can be seen from FIG. 1. However, if the displacing movement continues, a protuberance 62 of the inner end of the projection 46 reaches a protrusion 64 formed by the dish 18, so that the hand lever 28 is again held in the dish in the end position shown in FIG. 11. This locking position can also be achieved in that the hand lever which is initially folded out is pressed into the dish, wherein the projection 46 located in the end position shown in FIG. 11 is automatically pressed down by some distance against the force of the spring 54, specifically in that the protuberance 62 has a bevel which contacts a corresponding bevel 66 of the protuberance 64 and results in a displacement of the two protuberances relative to one another when the hand lever 28 is pressed. The advantage of this function consists in that the hand lever achieves a locked position simply by pressing the hand lever 28 into the dish without having to handle a padlock and without the need to lock, as the case may be, by actuating a key in a cylinder lock 40. By means of briefly tapping on the protrusion 46, the latter can be displaced downward by a short distance against the force of the spring 54 and can accordingly separate protuberance 62 from protuberance 64, so that the lever can be swiveled out.

However, the swiveled in position held by the protuberances 62, 64 is not a reliably locking position because any unauthorized person can move the hand lever out of this swiveled in position. In order to prevent this, the projection 46 can be moved, according to the invention, into the downward position, already described above, in which the two eyelet openings 48, 50 are aligned with one another and allow a shackle of a padlock to be inserted. In this position with inserted padlock, the hand lever is fixedly and securely locked and this locking state is also clearly visible. In addition, it is, of course, also possible to provide a cylinder lock which likewise enables locking. This additional locking can be key-actuated with a three-cornered, key four-cornered key or other shape of the key tip or can have a slot for screwdrivers. Two different keys would then be needed for unlocking, which is advantageous in certain cases of application.

Since the two eyelets 48, 50 swivel outward with the actuating lever 28, the surface of the released dish 18 does not project out in a troublesome manner, so that the user's hand is not impeded and cannot be injured.

Figure 4:
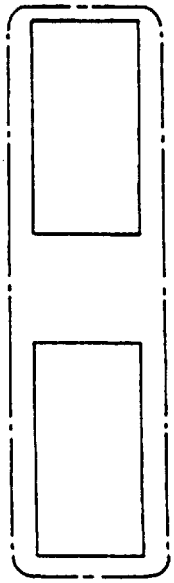
FIG. 4 shows the installation opening in a door for the closure according to FIG. 1
Figure 5:
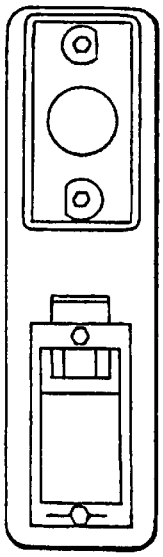
FIG. 5 shows a rear view of the swivel lever arrangement according to FIG. 1.
Figure 13:
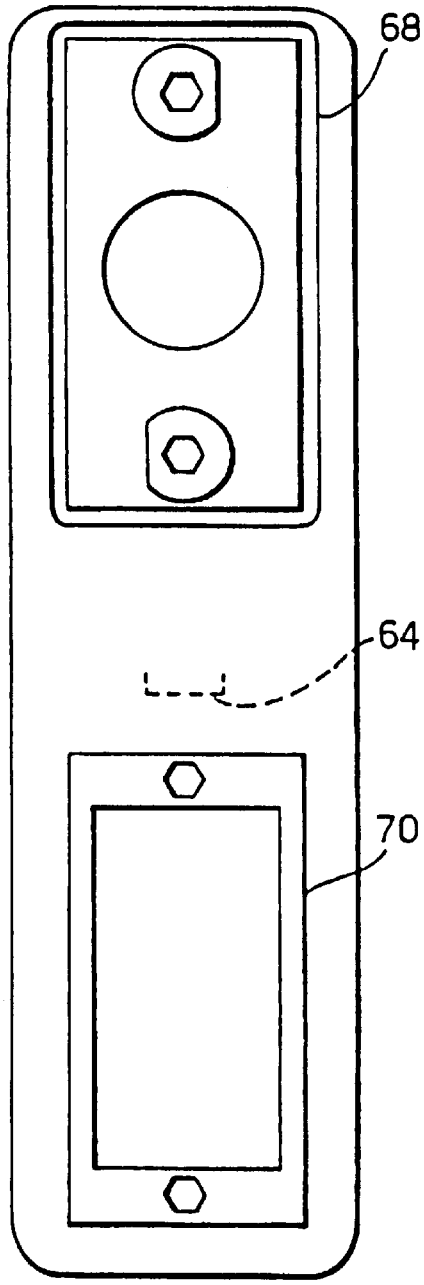
FIG. 13 shows a rear view of the dish of the arrangement according to FIG. 12.
Figure 14:
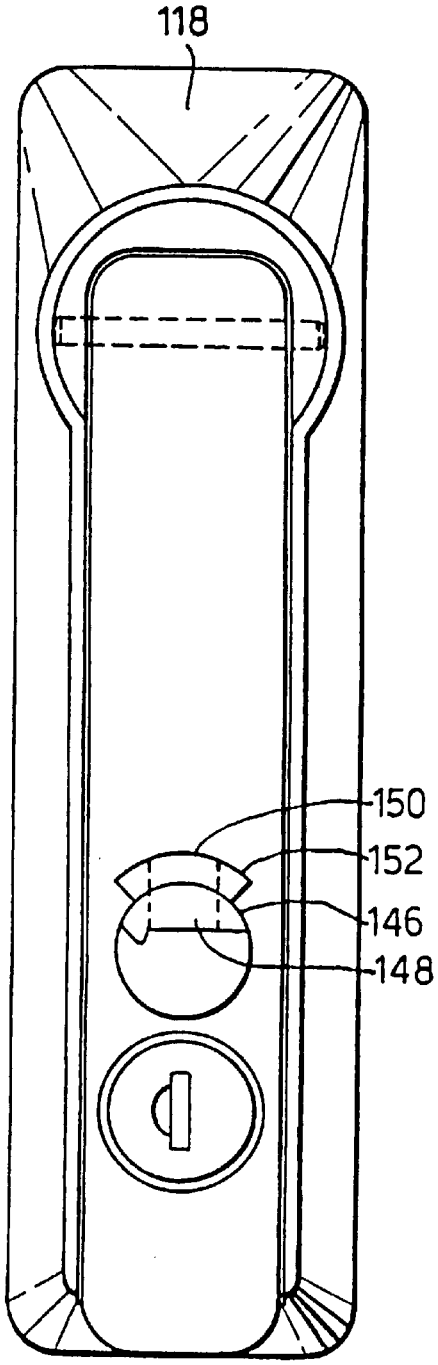
FIG. 14 shows a view, similar to that in FIG. 10, of another embodiment form of the invention.
Figure 15:
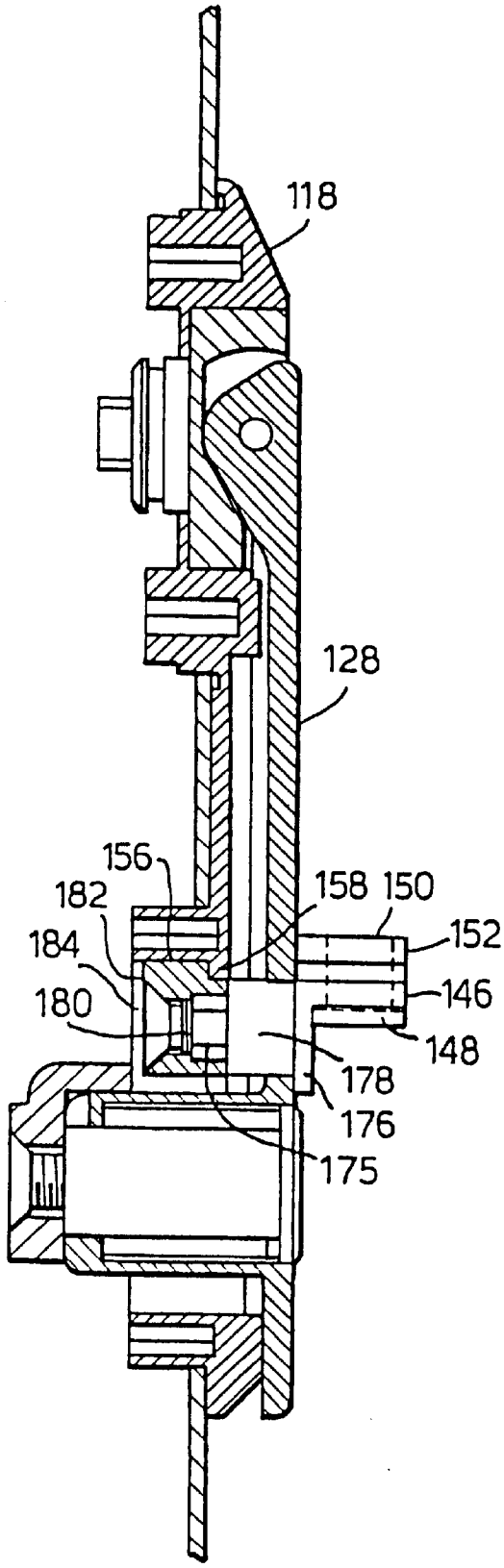
FIG. 15 shows an axial sectional view through the embodiment form according to FIG. 14.

The embodiment forms shown above are particularly well-suited for installation in two identically-sized rectangular openings oriented to the center of the door as is shown in FIG. 4. For this purpose, the dish 18 has protrusions 68, 70 (see FIGS. 11 and 13) which are directed toward the door leaf 14 and penetrate the latter, wherein, for example, lock casings 44 constructed in a suitably fitting manner can be placed thereon according to FIG. 1 and can be screwed on by fastening screws 72, 74, the door leaf being clamped between the dish 18 and upper casting 44 of closure 12 containing lock shaft 20, and lower casting 44 covering cylinder lock 40, as can be seen in FIG. 1. The screws 72, 74 penetrate into corresponding bore holes 76, 78 which are formed by the dish 18 which may be made of plastic (see, e.g., FIG. 11).

FIGS. 14 to 18 show a somewhat modified embodiment form. The two projections 146, 152 arranged on the hand lever 128 are arranged with their eyelets 148, 150 in an aligned position relative to one another in such a way that the shackle of a padlock is inserted in the direction of the axis of the hand lever. The projection 146 can be rotated by 90° about an axis 74 into the position shown in FIG. 16. A protrusion 156 which is formed by the inner end 157 and, in the locked position according to FIG. 15, contacts a shoulder 158 formed by the dish 1 18, is then released and makes it possible for the hand lever 128 to be swiveled out of the dish 118. The structural component part 152 may be cast integral with the hand lever 128. The structural component part 146 is formed of four parts, namely a part containing the bore hole 148 (see also the top view according to FIG. 14), a diskshaped part supported on the surface of the hand lever 128 (reference number 176), a bearing component part 178 with a round outer circumference which is rotatably mounted in a corresponding bore hole of the hand lever 128, and a four-cornered protrusion 180 on which an additional structural component part 182 is mounted and fastened by a countersink screw 184, namely so as to be rigid against rotation. The structural component part 182 forms the protrusion 156 which is supported on protrusion 158 and fixes the hand lever 128 in the swiveled in position.

Figure 16:
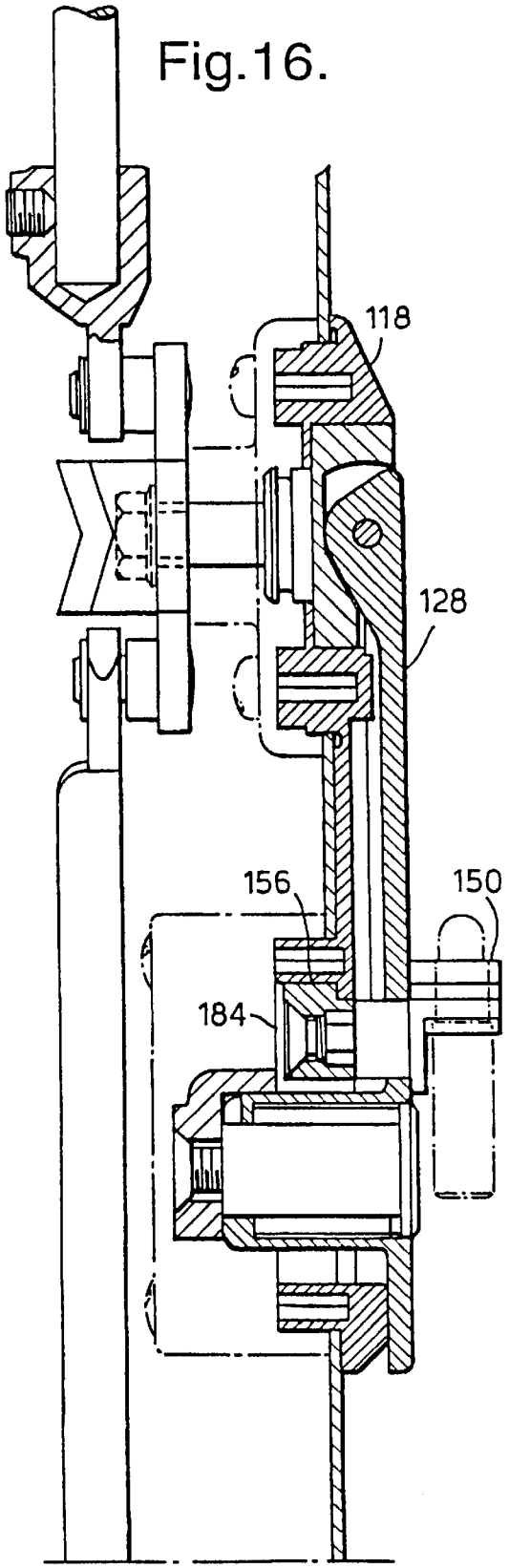
FIG. 16 shows the arrangement according to FIG. 15 in connection with a round rod closure.
Figure 17:
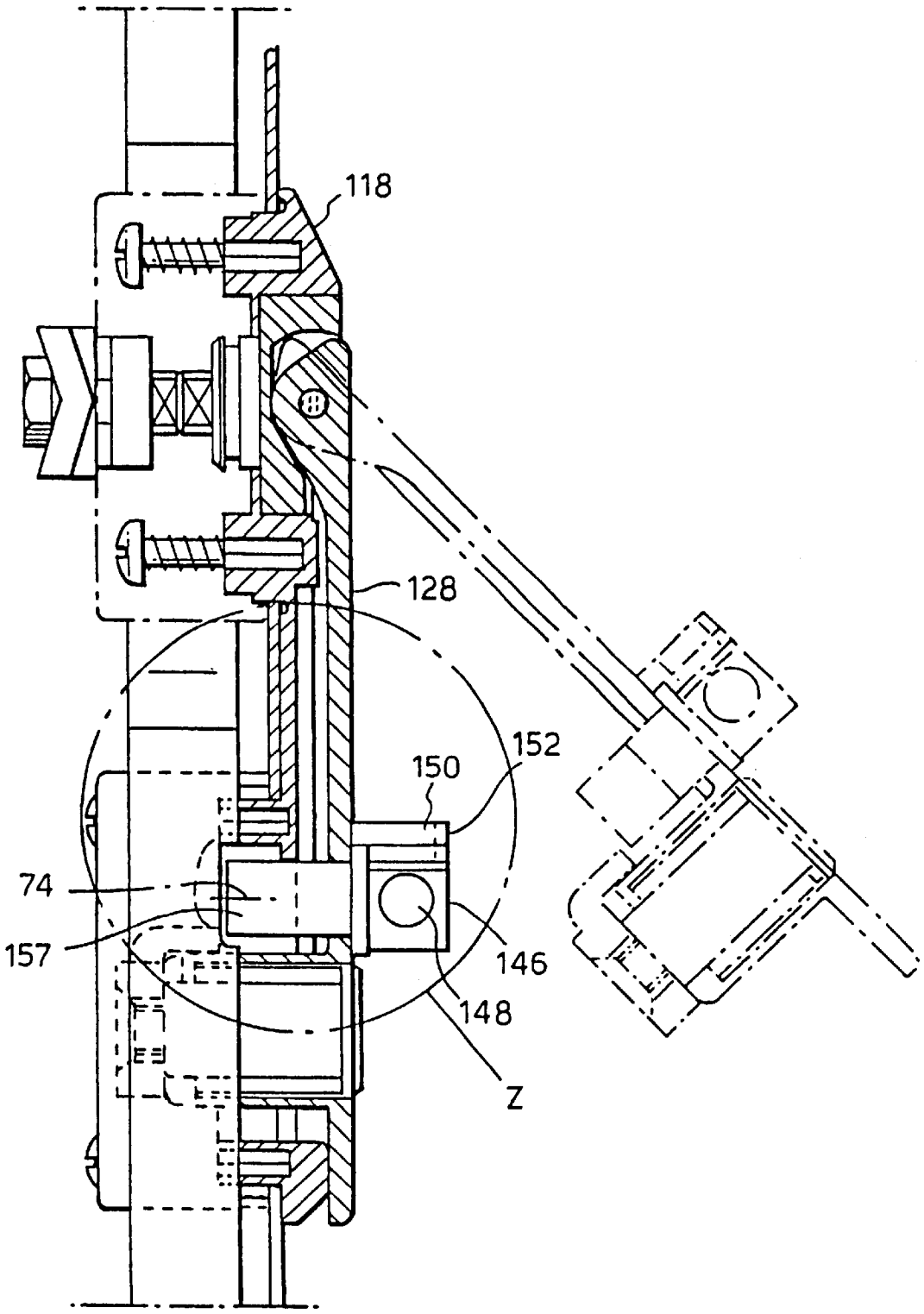
FIG. 17 shows an arrangement corresponding to FIG. 15, but in another position of the eyelets and in connection with a flat rod closure.
Figure 19:
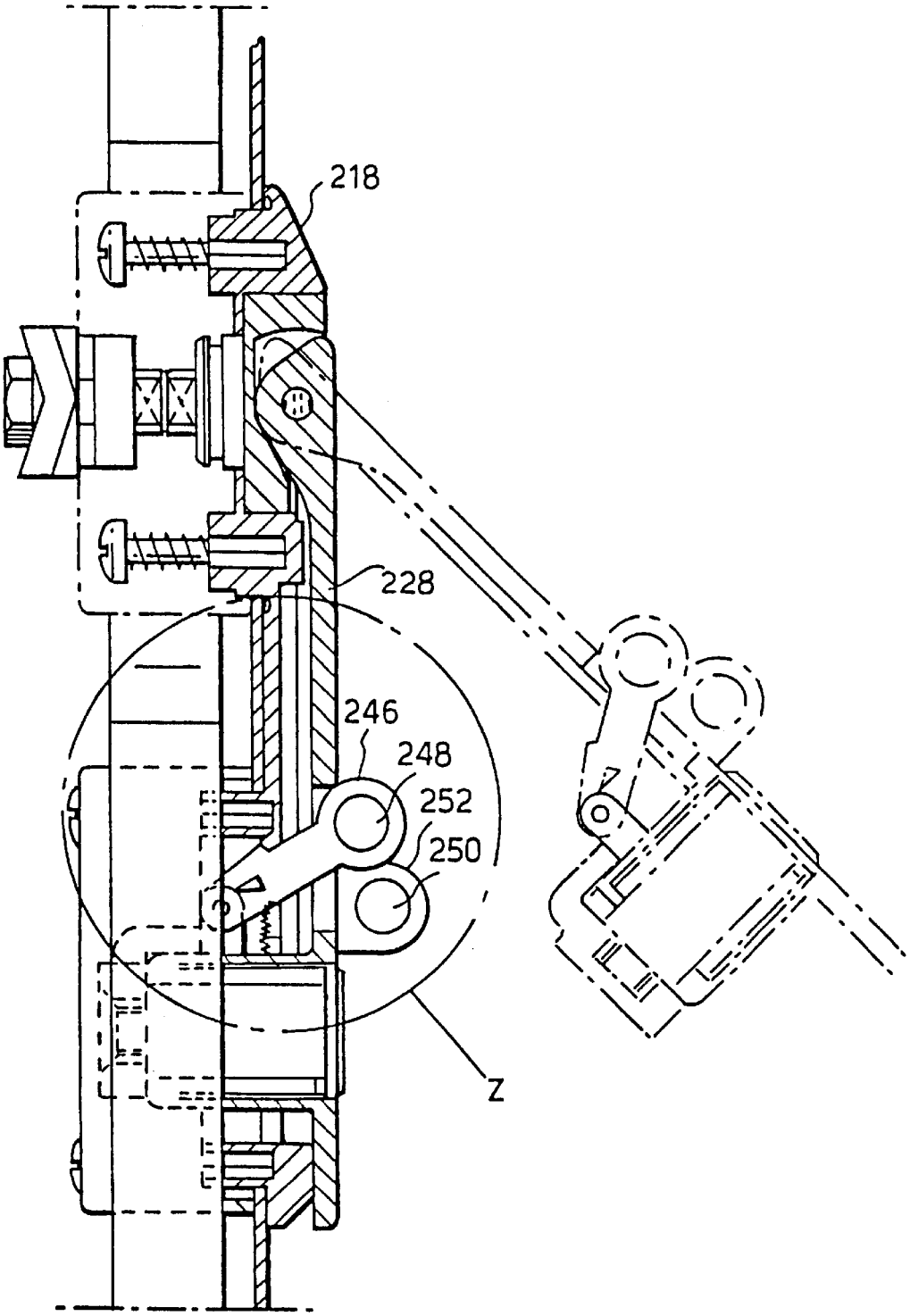
FIG. 19 shows a view, similar to that in FIG. 17, of another embodiment form of the securing device according to the invention in the unlocked position.
Figure 20:
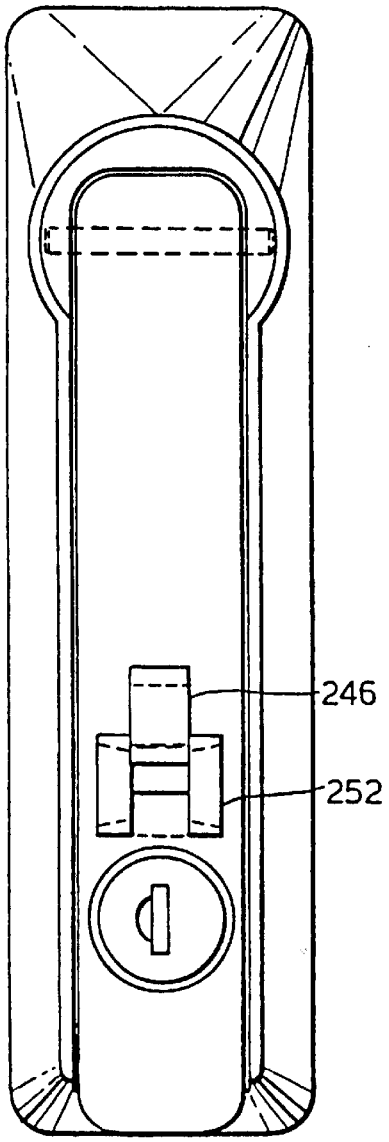
FIG. 20 shows a top view of the arrangement according to FIG. 19.

In this case also, the arrangement can be carried out in such a way that the rotating movement is effected against spring force, so that, as was described in FIGS. 1 to 11, a locking of the hand lever is made possible in the position according to FIG. 16 as well as in the end position according to FIG. 17, while the hand lever 128 can be swiveled out between these two positions.

Figure 18:
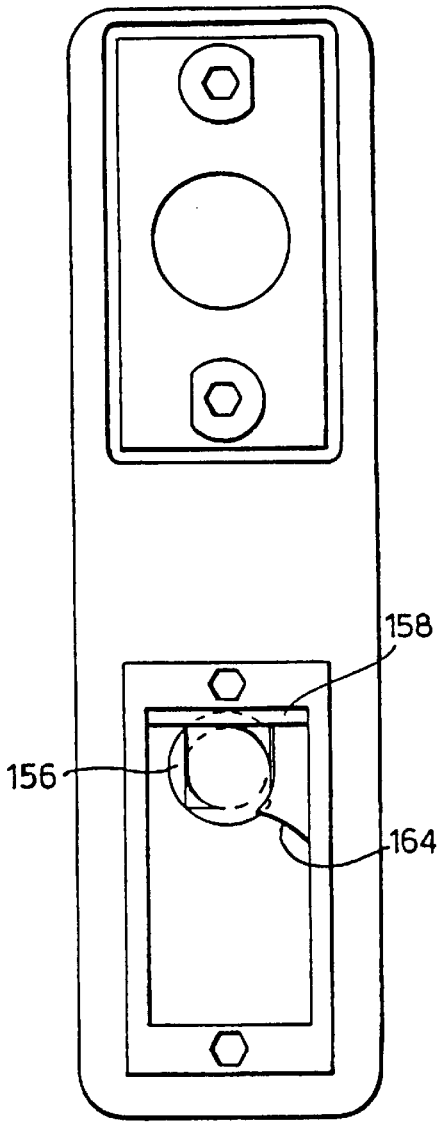
FIG. 18 shows a view of the dish part of the embodiment form according to FIG. 16.

This situation can be seen in FIG. 18, where the corner 164 brings about this automatic locking carried out when sliding in. The annular space 175 shown in FIG. 15 could receive a corresponding helical spring.

Figure 21:
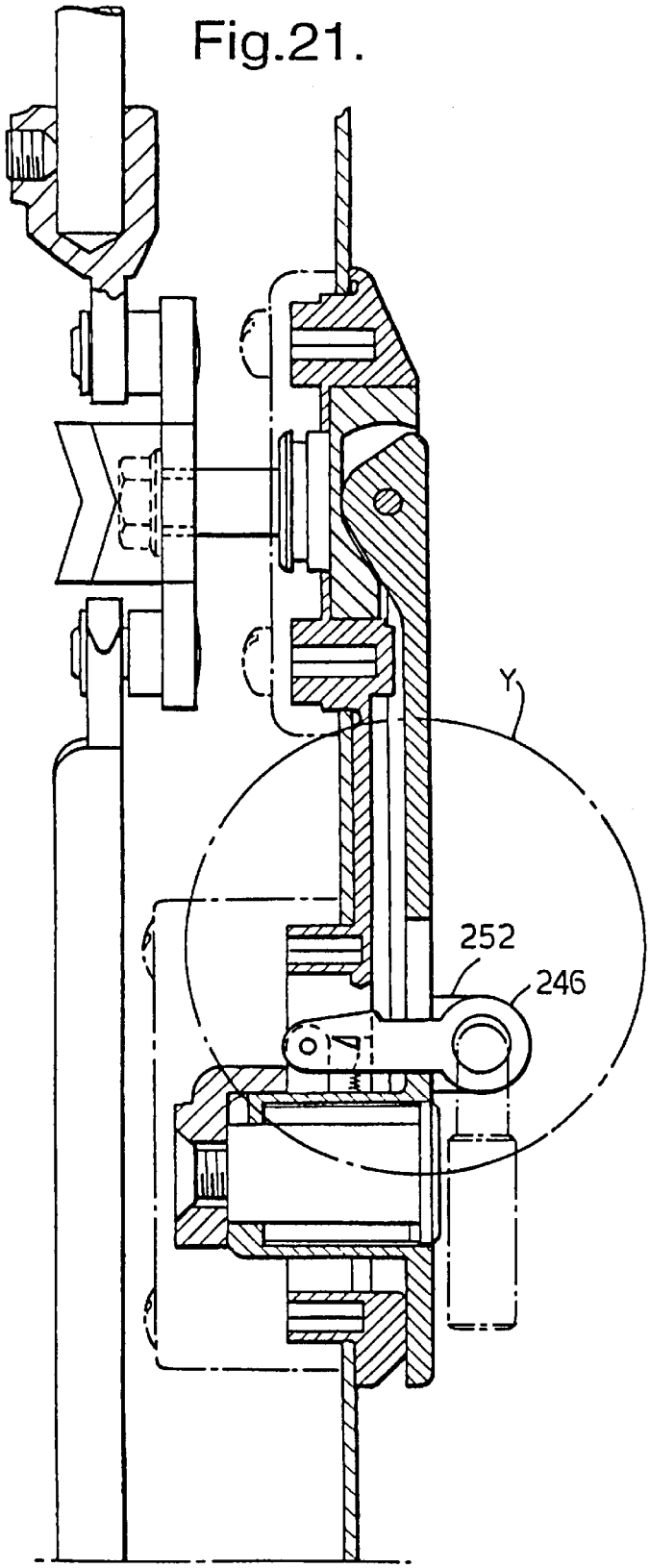
FIG. 21 shows the embodiment form according to FIG. 19 in the locked position.
Figure 22:
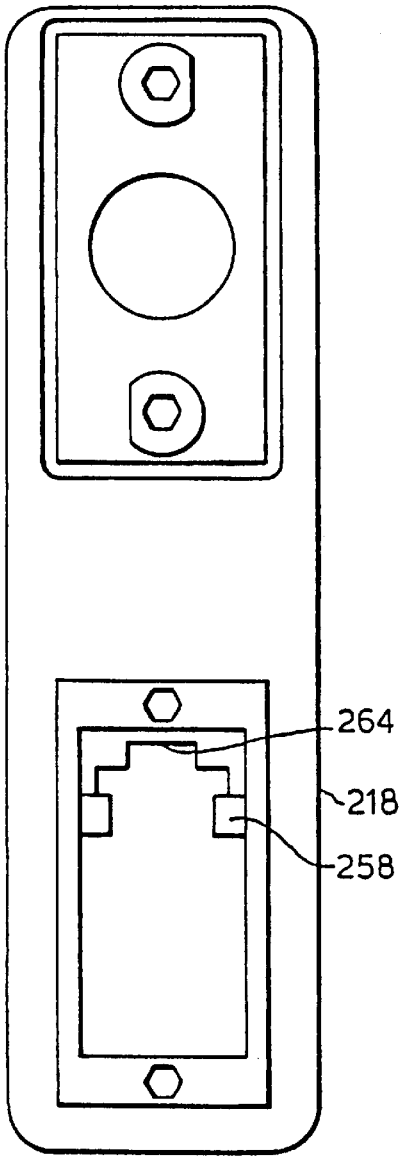
FIG. 22 shows a rear view of the respective dish.
Figure 23:
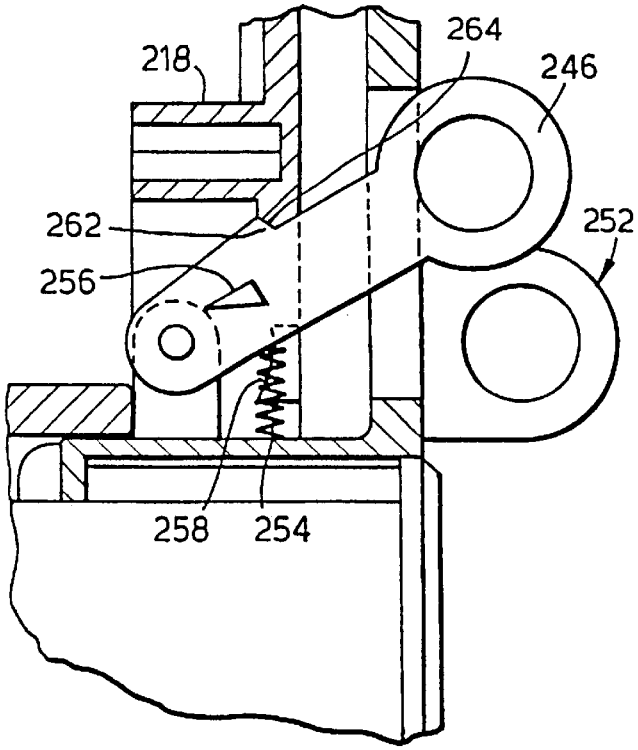
FIG. 23 shows an enlarged view of the eyelets according to FIG. 19.
Figure 24:
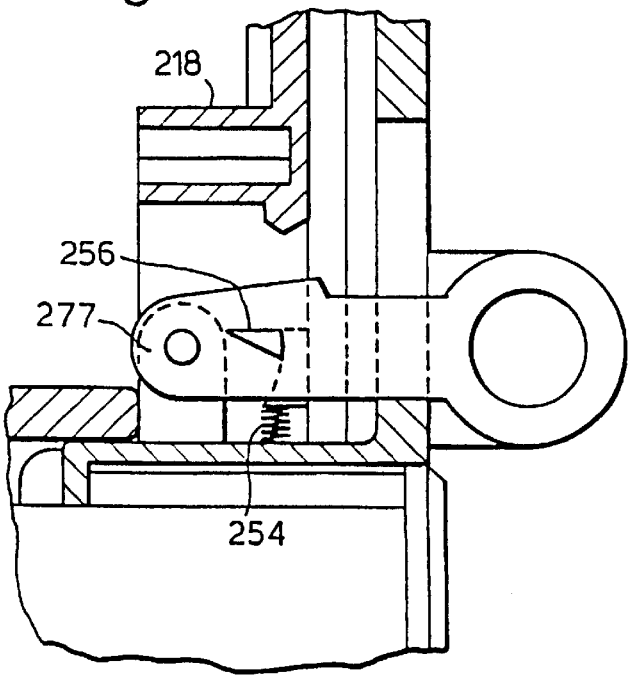
FIG. 24 shows an enlarged view of the eyelets according to FIG. 21.
Figure 25:
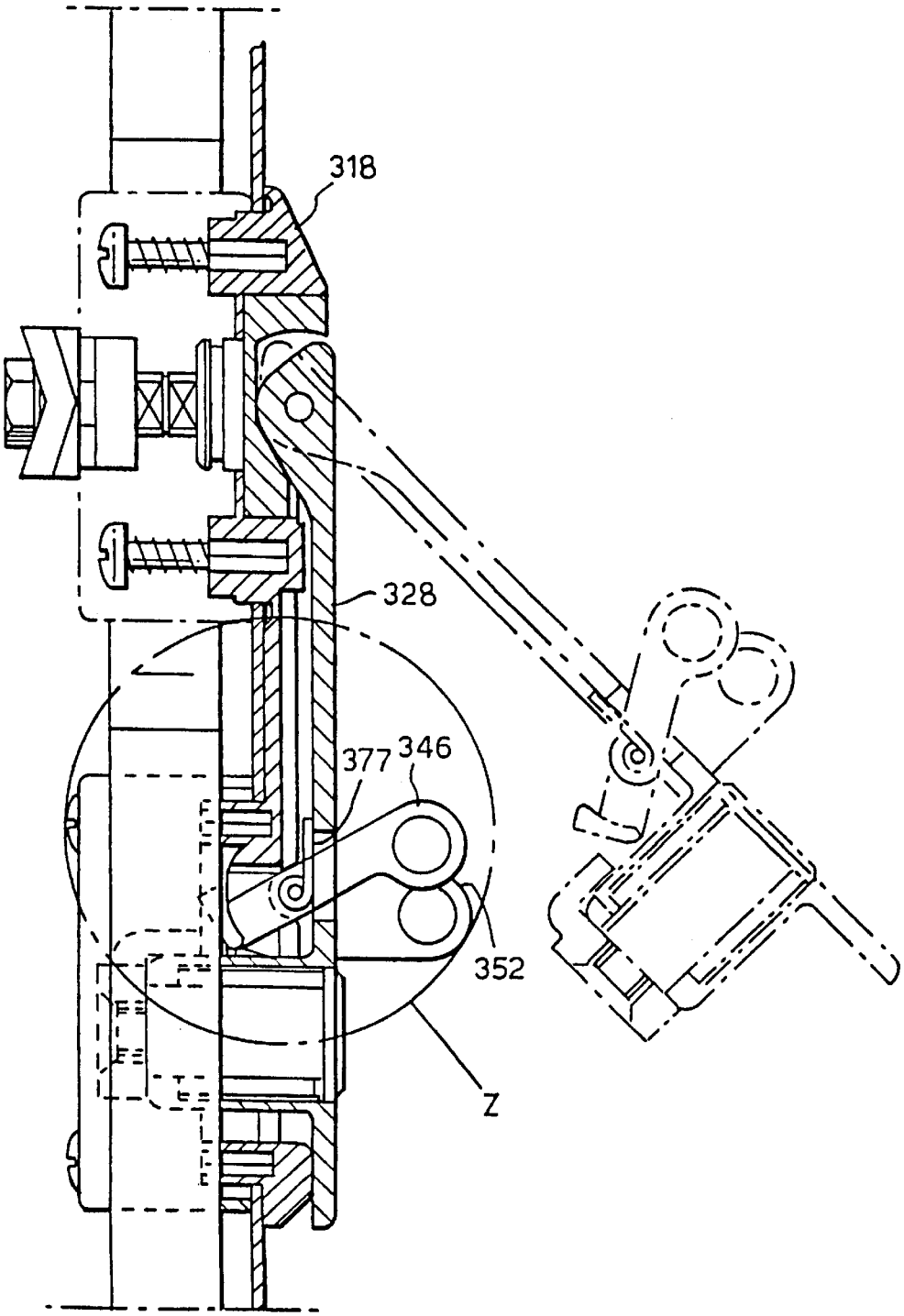
FIG. 25 shows a view, similar to FIG. 19, of another embodiment form of the invention in connection with a flat rod closure in the unlocked position.
Figure 26:
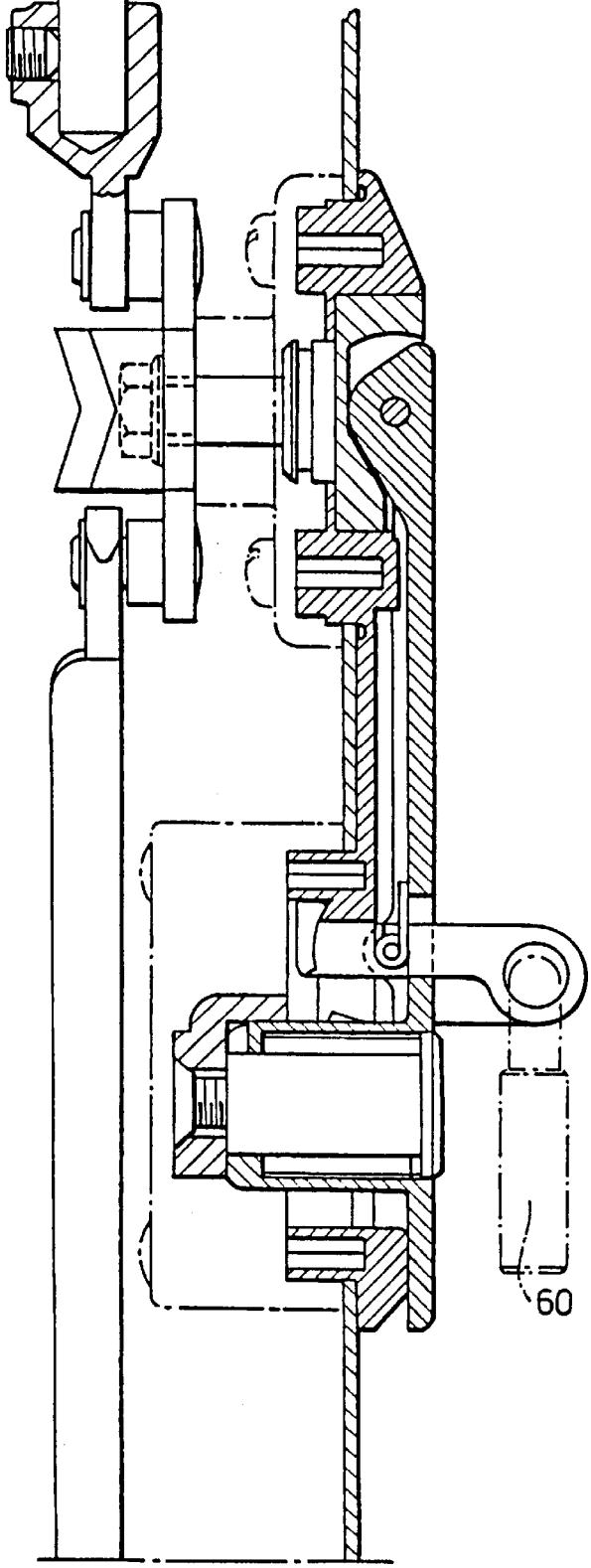
FIG. 26 shows the arrangement according to FIG. 25 in connection with a round rod closure in the locked position.
Figure 27:
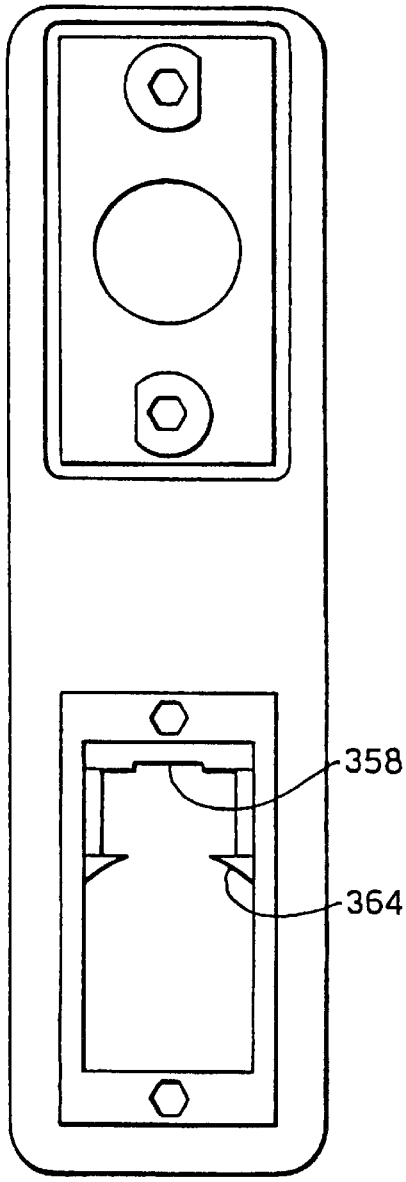
FIG. 27 shows a rear view of the respective dish.

Another construction possibility is shown in FIGS. 19 to 24. Instead of a displaceable projection such as that shown, for example, by 46 in FIG. 1, there is provided, in this case, a swivelable projection 246 which is fixed to the hand lever 228. The projection 246 is fastened to the hand lever 228 so as to be swivelable about an axis 277 against the force of a spring 254. Similar to the embodiment forms which were described above, the projection 246 has two locking positions: one regular locking position in which eyelet 248 of projection 246 is aligned with eyelet 250 of projection 252 and in which a padlock can be inserted through these two eyelets (see also the view in FIG. 21) and a second position shown in FIG. 19 in which locking also takes place, namely, in this case, by means of a protuberance 262, see FIG. 23 which is formed by the projection 246 and comes to rest against a protuberance 264 of the dish 218. This locking position is automatically achieved in that diagonal surfaces slide along one another when the hand lever 228 is swiveled into the dish 218 and press this projection 246 in the clockwise direction against the force of the helical spring 254, whereupon the protuberances 262, 264 arrive in their locking position after sliding past one another. In the opposite position in which the two eyelets or openings 248, 250 are aligned with one another as is shown in FIG. 21, so that a padlock can be inserted through the latter if required, a protrusion 256 formed by the projection 246 lies behind a protrusion 258 formed by the dish 218, so that the hand lever 228 can no longer be folded out of the dish 218 in this position even when a padlock is not inserted.

FIGS. 25 to 29 show a somewhat modified swiveling arrangement. It differs from that shown in FIGS. 19 to 24 in that the swiveling axis location with the respective spring 377 lies somewhat closer to the surface of the hand lever 328 and the swivelable projection 346 is given slightly different application points for locking.

Figure 28:
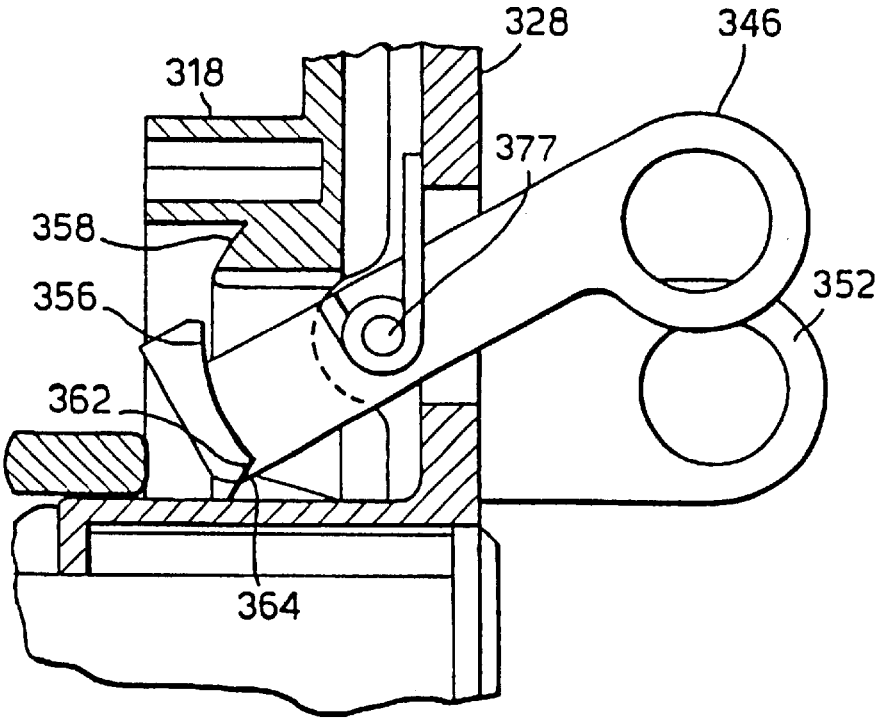
FIG. 28 shows an enlarged view of the area emphasized in FIG. 25.
Figure 29:
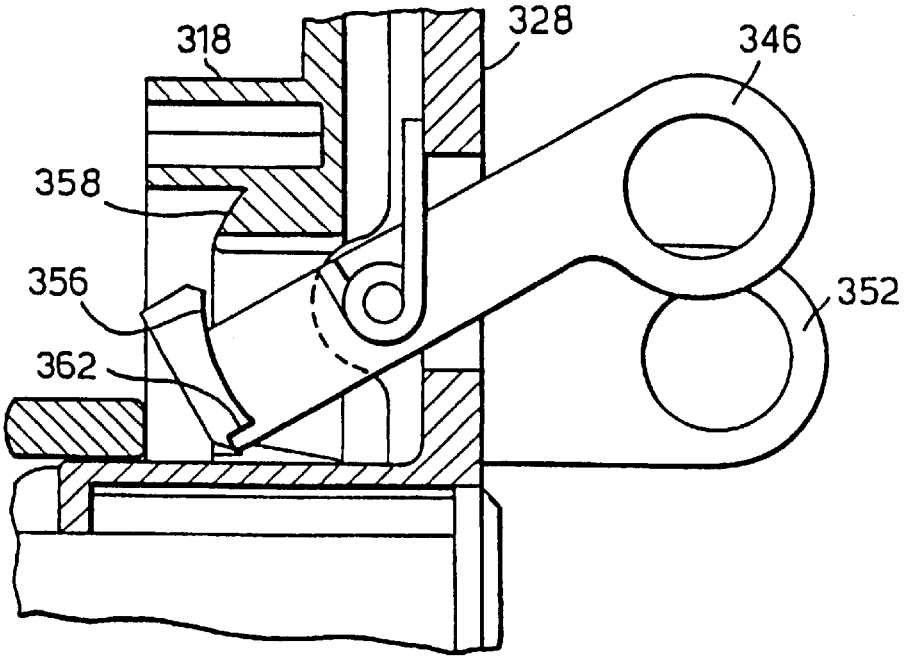
FIG. 29 shows a variant of the embodiment form according to FIG. 28.

FIGS. 28 and 29 differ only minimally with respect to the projection 345 for locking when swiveling in without the use of a padlock.

The embodiment form according to FIGS. 19 to 24 has proven the most advantageous; it is more advantageous than the embodiment form according to FIGS. 25 to 29 because the projections 246, 252 in this case project out less than in the embodiment form with the projections 346, 352. It is more advantageous compared to the embodiment form according to FIGS. 1 to 11 because displacement is more complicated to carry out than swiveling.

It is expressly noted that the eyelet which is fixedly arranged on the lever for locking the lever need not necessarily conform in contour to the moveable eyelet providing the back-engagement. When using small padlocks with thin shackles, an overlapping of the two eyes of the eyelets is sufficient to ensure that the lever is securely held in its dish.

The swivel lever locking according to the invention can also be used in closures which are actuated already by swiveling out the actuating lever, that is, which do not require subsequent turning of the swivel lever.

While the foregoing description and drawings represent the present invention, it will be obvious to those skilled in the art that various changes may be made therein without departing from the true spirit and scope of the present invention.

The invention can be used commercially in switch cabinet construction.

What is claimed is:

1. A swivel lever actuator which can be secured by a padlock for the closure of switch cabinet doors comprising:

a dish which is adapted to be arranged on an outer surface of the door and in which is arranged a driving device for the closure;

an actuating lever being articulated at the driving device so as to be swivelable out of the dish about an axis extending parallel to the outer surface of the door;

a first projection being mounted on the actuating lever;

an eyelet being arranged at a free end of the f projection so that when the actuating lever is swiveled into the dish, a padlock inserted through the eyelet prevents the actuating lever from swiveling out;

the first projection being mounted at the actuating lever so as to be at least one of displaceable, rotatable and swivelable relative to the lever;

the actuating lever having a second projection with an eyelet; and said eyelet of the first projection being situated close to and flush with the eyelet of the second projection in an end position of the first projection in which the actuating lever is prevented from swiveling out.

2. The swivel lever actuator according to claim 1, wherein the at least one of displaceable, rotatable and swivelable projection likewise preventsthe actuating lever from swiveling out in a second end position.

3. The swivel lever actuator according to claim 1, wherein the first projection which is fastened to the actuating lever so as to be at least one of displaceable, rotatable and swivelable extends into an undercut area of the dish and engages behind this area by a protuberance.

4. The swivel lever actuator according to claim 1, wherein the movement of the fir projection is effected against the force of a spring.

5. The swivel lever actuator according to claim 1, wherein the second projection is fixedly mounted on the actuating lever or is formed integral therewith m is U-shaped and receives the first projection between its U-shaped legs.

6. The swivel lever actuator according to claim 1, wherein the actuating lever has, in addition, a cylinder lock whose locking member engages in a locking manner behind a contact surface of the dish.

7. The swivel lever actuator according to claim 1, wherein the dish has two protrusions adapted to extend through the door and wherein one protrusion forms a lock shaft support; while the other protrusion forms undercuts for locking the movable projection of the actuating lever.

8. The swivel lever actuator according to claim 7, wherein a contact surface for a cylinder lock that may possibly be provided is formed in the area of the other protrusion.

9. The swivel lever actuator according to claim 7, wherein the protrusions form bore holes in which fastening screws can be screwed for additional parts, such as lock casings or covers, which can be screwed onto the dish and which clamp a door leaf between them.

10. The swivel lever actuator according to claim 1, wherein it is used for actuating one of a flat rod closure, a round rod closure, or a sash closure.

11. A swivel lever rod closure for switch cabinet comprising:

a swivel lever actuator that can be secured by a padlock;

a dish which is adapted to be arranged on an outer surface of a door and in which is arranged a driving device for the closure;

said actuating lever being articulated at the driving device so as to be swivelable out of the dish about an axis extending parallel to the outer surface of the door;

a first projection being mounted on the actuating lever;

an eyelet being arranged at a free end of the first projection so that when the actuating lever is swiveled into the dish, a padlock inserted through the eyelet prevents the actuating lever from swiveling out;

said first projection being mounted at the actuating lever so as to be at least one of displaceable, rotatable and swivelable relative to the lever;

said actuating lever having a second projection with an eyelet; and said eyelet of the first projection being situated close to and flush with the eyelet of the second projection in an end position of the first projection in which the actuating lever is prevented from swiveling out.

12. The closure with swivel lever actuator according to claim 11, wherein the displaceable, rotatable and swivelable projection likewise prevents the actuating lever from swiveling out in a second end position.

13. The closure with swivel lever actuator according to claim 11, wherein the projection which is fastened to the actuating lever so as to be at least one of displaceable, rotatable and swivelable extends into an undercut area of the dish and engages behind this area by a protuberance.

14. The closure with swivel lever actuator according to claim 11, wherein the movement of the first projection is effected against the force of a spring.

15. The closure with swivel lever actuator according to claim 11, wherein the second projection is fixedly mounted on the actuating lever or is formed integral therewith and is U-shaped and receives the first projection between its U-legs.

16. The closure with swivel lever actuator according to claim 11, wherein the actuating lever has, in addition, a cylinder lock whose locking member engages in a locking manner behind a contact surface of the dish.

17. The closure with swivel lever actuator according to claim 11, wherein the dish has two protrusions adapted to extend through the door and wherein one protrusion forms a lock shaft support, while the other protrusion forms undercuts for locking the moveable projection of the actuating lever.

18. The closure with swivel lever actuator according to claim 17, wherein a contact surface for a cylinder lock that may possibly be provided is formed in the area of the other protrusion.

19. The closure with swivel lever actuator according to claim 17, wherein the protrusions form bore holes in which fastening screws can be screwed for additional parts, such as lock casings or covers, which can be screwed onto the dish and which clamp a door leaf between them.

20. The closure with swivel lever actuator according to claim 11, wherein it is a flat rod closure or a round rod closure, with or without a sash closure, whose locking rods are guided at the door by means of rod guides and which are displaced in the rod guides in such a way by means of the driving device coupled with the swivel lever actuator.

21. The swivel lever actuator according to claim 1, wherein the driving device forte closure is a toothed-wheel drive.

22. The swivel lever actuator according to claim 1, wherein the driving device for the closure is a lever drive.

23. The swivel lever actuator according to claim 1, wherein the driving device for the closure is a lock shaft.

24. The closure according to claim 11, wherein the driving device is a toothed-wheel drive.

25. The closure according to claim 11, wherein the driving device is a lever drive.

26. The closure according to claim 11, wherein the driving device is a lock shafts.

* * * * *